United States Patent [19]

Cohen et al.

[11] 4,087,985

[45] May 9, 1978

[54] APPARATUS AND METHOD FOR THERMAL POWER GENERATION

[75] Inventors: Paul Cohen, Pittsburgh; Arnold H. Redding, Export, both of Pa.

[73] Assignee: Westinghouse Electric Corp., Pittsburgh, Pa.

[21] Appl. No.: 667,793

[22] Filed: Mar. 17, 1976

[51] Int. Cl.[2] ..... G21D 5/08; F01K 3/00

[52] U.S. Cl. ..... 60/644; 60/670; 60/678

[58] Field of Search ..... 60/653, 654, 670, 671, 60/651, 677, 678, 679, 680, 644, 646, 657

[56] References Cited

U.S. PATENT DOCUMENTS

| | | | |
|---|---|---|---|
| 1,919,981 | 7/1933 | Le Sur | 60/678 X |
| 2,927,434 | 3/1960 | MacCracken | 60/677 |
| 3,030,779 | 4/1962 | Hryniszak | 60/644 X |
| 3,277,651 | 10/1966 | Augsburger | 60/679 X |
| 3,421,978 | 1/1969 | Gollion | 60/644 |
| 3,438,202 | 4/1969 | Roe | 60/678 |
| 3,973,402 | 8/1976 | Silvestri, Jr. | 60/680 X |

*Primary Examiner*—Allen M. Ostrager
*Attorney, Agent, or Firm*—Edward L. Levine; Z. L. Dermer

[57] ABSTRACT

An improved thermal power plant and method of power generation which minimizes thermal stress and chemical impurity buildup in the vaporizing component, particularly beneficial under loss of normal feed fluid and startup conditions. The invention is particularly applicable to a liquid metal fast breeder reactor plant.

11 Claims, 4 Drawing Figures

APPARATUS AND METHOD FOR THERMAL POWER GENERATION

BACKGROUND OF THE INVENTION

The invention described herein was made in the course of, or under, a contract with the U.S. Energy Research and Development Administration (ERDA), the successor in interest to the U.S. Atomic Energy Commission (AEC).

1. Field of the Invention

This invention relates to a method for the generation of power and also to a thermal power plant for utilization of the method. More particularly, it relates to a vaporizable fluid cycle, typically a steam cycle, for a liquid metal cooled nuclear reactor, which minimizes temperature differences between working fluids in the steam generator, and provides continued flow from an available inventory of heated fluid to minimize thermal transients during startup and upon loss of normal feed fluid flow, the inventory of heated fluid having a chemical composition similar to the normal feed fluid.

2. Description of the Prior Art

Liquid metal cooled fast breeder nuclear reactors typically include three fluid circuits to achieve the generation of electrical power. The first, or primary fluid circuit, circulates a liquid metal, such as sodium, which removes heat generated in the reactor core and transfers it, through a heat exchanger, to an intermediate fluid in the second circuit. The intermediate fluid is typically similar to the primary fluid, and transfers heat to a vaporizable fluid in a utilization circuit, typically to water in a steam cycle. The main component in which the fluid is vaporized by heat from the intermediate circuit is referred to as a steam generator.

In certain systems the steam generator is desired to be of a "once-through" type; that is, there is no recirculation of the utilization fluid in an evaporator or drum component. The utilization fluid, subsequent to condensation in the turbine-generator condenser, passes through a series of heating stages, enters the steam generator and is then evaporated and most often times superheated. Superheating may take place in the steam generator or in a separate unit. The fluid then passes to the turbine-generator and condenser, completing the circuit.

Two major concerns experienced in operation of such steam generators in the prior art are (1) thermal stresses induced by temperature differences between the intermediate and utilization fluids, and (2) the necessity to provide an auxiliary source of utilization fluid and means for its injection if the steam generators are to be used for decay heat removal, that is, the heat which continues to be released after the reactor has been shut down or is in hot standby.

An alternate method for providing continued cooling has been to provide one or more circuits for cooling of primary or secondary sodium systems with air. A further general alternate has been to use a recirculating steam generator, with natural or forced circulation, and a steam drum containing a significant inventory of boiler water. This permits continued steam generation and cooling after loss of feed fluid flow, causing minimum temperature changes and providing time for initiation of alternate auxiliary cooling systems. Because of the rapid decrease with time of the heat release rate, such auxiliary systems then can be designed for lower maximum capabilities. The disadvantage of this design is the consequent increased requirements in the size of the evaporator sections of the steam generators to permit the high recirculation ratio required for adequate heat transfer with the recirculated water. It is characteristic of recirculating steam generators that impurities in the feedwater are accumulated in the evaporator section and concentrations are limited only by blowdown of boiler fluid or carry over to the superheater. If, in the interests of economy of first cost, the recirculation ratio, and hence evaporator size, is decreased, a situation is achieved where heat transfer conditions correspond more to once-through operation, but at the higher concentration of feedwater impurities characteristic of recirculating units. To limit concentration of impurities to more acceptable levels, very high blowdown rates from the steam generator are required.

Further, whether a once-through or recirculation type is utilized, upon accident conditions such as loss of normal feed fluid flow, the auxiliary fluid must be immediately supplied to the steam generator to remove heat from the intermediate fluid, and hence the primary fluid, during the time period necessary to effect a controlled shutdown of the reactor. In addition to the above, many prior art systems have provided an additional available source of auxiliary fluid. However, this source is typically a large tank of fluid which is available for other plant functions as well, and is neither heated as is the normal feed fluid, nor is the chemistry controlled as finely as the normal feed fluid chemistry. Therefore, immediate injection of the auxiliary fluid may induce severe thermal stresses at the inlet and along the steam generator. Similarly, thermal stresses are also induced at the steam generator feed fluid inlet during startup conditions.

It is therefore highly desirable to provide a means whereby, during plant startup and during the initial stages of a loss of normal feed fluid incident when the necessary heat removal rate is greatest, that fluid with temperature and chemical properties identical to the normal feed fluid be provided to the steam generator. It is further desirable to provide a means for controlling the chemical properties of the feed fluid during normal and accident operation, to minimize the potential for chemical buildup in the steam generator. This invention provides such means, thereby minimizing the potential for thermal shock and impurity buildup in the steam generator.

SUMMARY OF THE INVENTION

This invention provides an improved thermal power plant and method of power generation which overcomes the prior art limitations of induced thermal stresses in the steam generator while further providing improved means of chemistry control. Thermal differences between working fluids in the steam generator are lessened during normal operation and particularly during plant startup and assumed accident conditions such as loss of normal feed fluid flow. Chemistry control of feed fluid is greatly improved during normal operation by minimizing the potential for accumulation of solids in the feed fluid entering the evaporator section of the steam generator.

The invention is particularly applicable to a liquid metal nuclear reactor plant which usually includes three main fluid circuits: a primary fluid circuit between the reactor heat source and a heat exchanger, an intermediate fluid circuit between the heat exchanger and a steam generator, and a utilization circuit circulating a vaporizable fluid used to drive a turbine-generator system. It is equally applicable to plants without an intermediate fluid circuit. The invention incorporates a preheater downstream of the normal feed fluid heaters in the utilization circuit, which places in heat transfer relation a portion of the vaporized fluid from the steam generator and the feed fluid. It further includes an inventory tank integral with, or downstream of the preheater. In the preferred embodiment, the preheater is a tube and shell type, and the portion of vaporized fluid used to preheat the feed fluid is subsequently collected in the inventory tank. Collected fluid from the inventory tank is then pumped into the main feed fluid stream exiting the preheater prior to discharge to the steam generator. In an alternate embodiment, the portion of vaporized fluid is actually mixed with the feed fluid in a spray condenser type preheater, and the combined fluid is collected in the inventory tank from which it is pumped to the steam generator. The invention may be beneficially incorporated in other nuclear and non-nuclear utilization circuits.

BRIEF DESCRIPTION OF THE DRAWINGS

The functions and advantages of this invention will become more apparent from the following description and drawings, in which.

DESCRIPTION OF THE PREFERRED EMBODIMENTS

Figure 1:
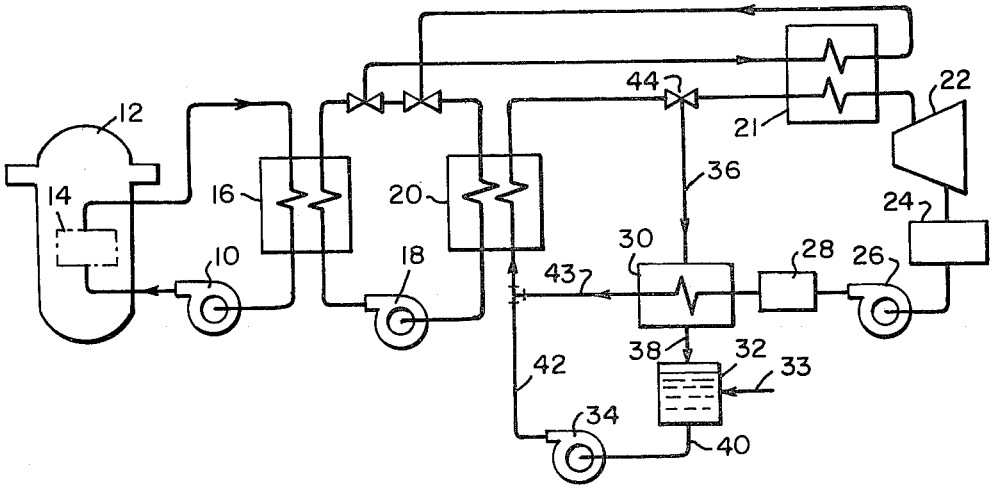
FIG. 1 schematically illustrates the primary, intermediate, and utilization circuits of a nuclear reactor plant incorporating one embodiment of the instant invention.
Figure 2:
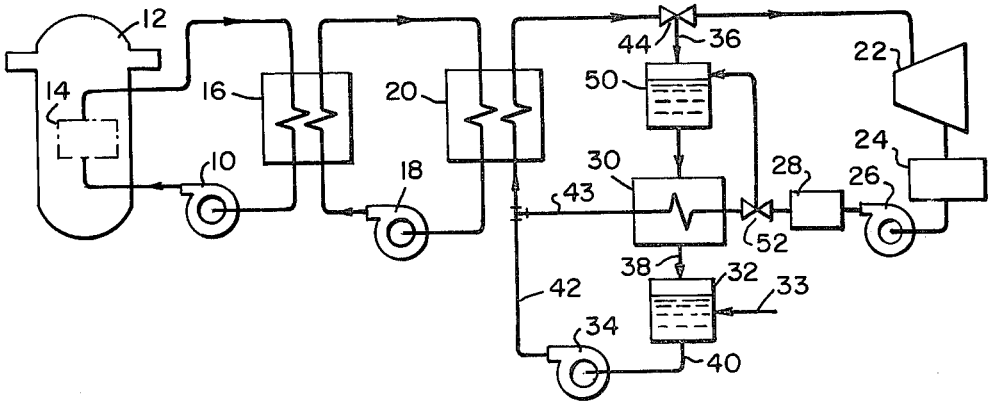
FIGS. 2, 3 and 4 schematically illustrate the circuits of FIG. 1 incorporating alternate embodiments of the instant invention.

Referring now to the drawings, FIG. 1 schematically illustrates the three main fluid circuits in a typical liquid metal cooled fast breeder reactor plant. In the primary circuit, reactor coolant, such as sodium, is discharged by a primary pump 10 to the reactor vessel 12, passes through the core 14 where it removes heat generated by nuclear fission, and then flows to an intermediate heat exchanger 16 where heat is transferred to an intermediate fluid, such as sodium. Other components shown in the intermediate circuit are an intermediate pump 18, a steam generator 20, and a superheater 21. The intermediate fluid is discharged from pump 18 to the heat exchanger 16 where the fluid is heated by the primary fluid; it then flows to the superheater 21 providing energy to superheat the utilization fluid, and then to the steam generator 20, transferring heat to vaporize the fluid in the utilization circuit, and returns to the pump 18, completing the circuit. In a typical plant, the utilization circuit also includes a turbine 22 or series of turbines, a condenser 24, feed fluid pumps 26 and feed fluid heaters 28. The vaporizable utilization fluid, such as water to be transformed to steam, is discharged from the feed fluid pumps 26 through the series of feed fluid heaters 28, then through the steam generator 20 where it is vaporized, to the superheater where it is superheated, and to the turbine 22 where it expands and drives the turbine-generator system to produce electrical power, is then condensed in condenser 24, and returned to pump 26 completing the circuit. FIG. 1 shows a separate superheater unit 21, although superheating can also be performed in the steam generator 20 as shown in FIG. 2. Variations of the basic utilization circuit include multiple turbines, multiple condensers, reheating the utilization fluid between turbine stages and extraction of previously vaporized fluid from various locations in the turbine to heat the feed fluid heaters, among others, all of which may be used in conjunction with this invention. Furthermore, a typical liquid metal reactor plant incorporates a plurality of the above described circuits. For example, there may be a plurality of primary circuits, each circuit including a primary pump 10, which may be located downstream of the reactor vessel, and an intermediate heat exchanger 16, with each circuit flow connected to a common reactor vessel 12. Likewise, an identical number of intermediate circuits, each including the pump 18, heat exchanger 16, and steam generator 20 would be used. Typically, however, only one utilization circuit is incorporated, mixing vaporized fluid from the plurality of steam generators 20 before the fluid passes to the turbine 22. The fluid is commonly condensed and heated in the feed fluid heaters 28, and then separated so as to enter steam generator 20. The intermediate circuits may also be entirely eliminated, such that a plurality of primary circuits transfer heat at the steam generator directly to the utilization fluid.

The steam generator 20 is one of the most critical components in such plants, and must be protected accordingly. It functions as the physical barrier between the intermediate fluid, such as sodium, and the utilization fluid, such as water/steam, while providing heat transfer between the fluids. The violent exothermic reaction that occurs when sodium and water are mixed is well known, and significant mixing could possibly result in damage to the plant. The loss of generating capacity and expense of replacement power associated with repair of a steam generator 20 is extremely costly, especially when the replacement power is provided by fossil fuels. Any means which, therefore, help to ensure integrity of the steam generator 20, such as improved thermal transient and chemical control, will prove vitally important to world energy needs.

Steam generators 20 are of various designs, including primarily recirculating and once-through types. This invention is applicable to both. It is highly desirable in terms of turbine life and plant efficiency to generate superheated fluid in the steam generator 20 or a separate superheating or resuperheating component. As the steam generators 20 are very large, and must contain high pressures, in the range of 1000 to 2000 psi, a compact evaporator section is desirable, favoring a once-through steam generator 20. Among the major concerns in the operation of steam generators 20 are thermal stresses induced by temperature differences between working fluids, deposition on the surface of the steam generator tubes of chemical impurities during vaporization, and continued non-detrimental operation of the steam generator under accident and startup conditions. Most particularly, under accident conditions such as loss of normal feed fluid flow to the steam generators, these concerns are magnified.

Within the above context, the instant invention as illustrated in FIG. 1, minimizes the potential for detrimental effects upon the steam generator 20 under normal operation and accident conditions. The invention includes a utilization fluid condensing preheater 30, an inventory tank 32, an inventory pump 34, various conduits 36, 38, 40, 42, and 43 connecting the components in the manner shown, and means 44 to control the flow of utilization fluid in conduit 36. During normal plant operation, utilization fluid enters the steam generator 20 at or about saturated liquid conditions. It exits typically as a superheated vapor. Prior to entrance into the turbine 22, and as shown in the instant embodiment prior to entering the separate superheater unit 21, the fluid is separated into a major portion and a minor portion; the major portion continuing to the turbine 22 and the minor portion, amounting to up to about fifteen percent of the flow, being directed through the conduit 36. In the condensing preheater 30, typically a tube and shelf heat exchanger, the superheated fluid transfers heat to the feed fluid, and is condensed. As this component represents the final stage of feed fluid preheating, the flow rate of this superheated fluid may be adjusted to bring the feed fluid temperature close to saturated liquid conditions, or to other conditions which provide the best overall efficiency. The condensed fluid is then discharged to the inventory tank 32 which may be an integral part of the preheater 30. Therefore, the inventory tank will contain hot fluid with chemical specifications similar to the normal feed fluid. Fluid collected in the tank 32 is then pumped by the pump 34 through condiut 42, to mix with the feed fluid in conduit 43 prior to entry into the steam generator 20. The amount of vaporized fluid flow passing through conduit 37 may be adjusted to provide the desired thermal conditions of the feed fluid entering the steam generator. It may be controlled as with a typical three-element controller, based upon such parameters as steam or feed fluid flow or temperature.

The advantages of this invention during startup, steady state, and loss of normal feed fluid conditions will be readily apparent to one skilled in the art. During loss of feed fluid flow, fluid will immediately be directed from the inventory tank to the steam generator. This fluid is slightly hotter than the fluid normally supplied to the steam generator 20, thereby minimizing thermal shock and resulting thermal stress. Additionally, the fluid from the inventory tank 32 will have chemical specifications identical with the normal feed fluid. The capacity of the inventory tank 32 and preheater 30 can be optimized to provide sufficient fluid to minimize thermal stresses during the initial stages of the occurrence and provide acceptable plant efficiency. A source of auxiliary fluid may also be provided to remove heat during the later stages of the occurrence. It is preferably injected into the utilization circuit through the inventory tank 32, as shown by the auxiliary conduit 33. The auxiliary fluid will then enter the steam generator 20 when the temperature difference between the auxiliary fluid and the intermediate or primary fluid, has been reduced. It is evident that use of the invention results in similar advantages during plant startup conditions. During startup, prior art systems have evidenced a rather large thermal difference at the point of entrance of the feed fluid into the steam generator 20. As the reactor power and the temperature of intemediate fluid is raised, the temperature of the feed fluid lags the temperature rise of the intermediate fluid. This invention provides a means to more rapidly heat the feed fluid to minimize the temperature difference between the working fluids. More important, at steady state conditions, and during normal plant power changes, the invention provides better control of the chemical impurities contained in the feed fluid then prior art systems. Operating experience has shown improper chemistry control to be a factor contributing to failure of the steam generator 20 through increased potential for stress corrosion cracking and depositon of particulate matter on the tubes leading to local hot spots. By utilizing this invention, however, any accumulation of impurities is minimized without the necessity of high blowdown rates. Analysis of the utilization circuit indicates that there should be no accumulation of solids in the feed fluid entering the evaporator. Salts which are totally volatilized in the evaporator section will condense to fluid of feed fluid quality chemical composition in this respect. Nonvolatile impurities may be deposited but only to the extent that they are present in the feed fluid. Thus the art of feed fluid preparation suitable for once-through steam generators is applicable to this invention. Particularly in a once-through type steam generator, thermal differences in the steam generator are minimized while maintaining improved feed fluid chemistry.

FIG. 2 illustrates, similar to FIG. 1, the three main circuits in a typical liquid metal reactor plant, incorporating another embodiment of the instant invention. The Figure shows a utilization circuit without a separate superheating component 21, although such is also applicable to this embodiment. This embodiment differs primarily in incorporation of a spray-type desuperheater 50 in conduit 36. The desuperheater 50, which may be of various commonly used types, may be utilized to minimize the approach temperature difference between the two fluid streams entering the preheater 30. It cools the fluid in conduit 36 through heat transfer with a bypass fluid streams taken downstream of the feed fluid pumps 26 by flow control means 52 and conduits as shown. The flow control means 52 may operate by comparison of the temperature of the fluid in conduit 36 and temperature of the fluid downstream of the last feed fluid heater 28, utilized to adjust the flow of bypass fluid to the desuperheater 50. Other suitable parameters, such as fluid flow rate, can aslo be used to operate the flow control means 52.

Figure 3:
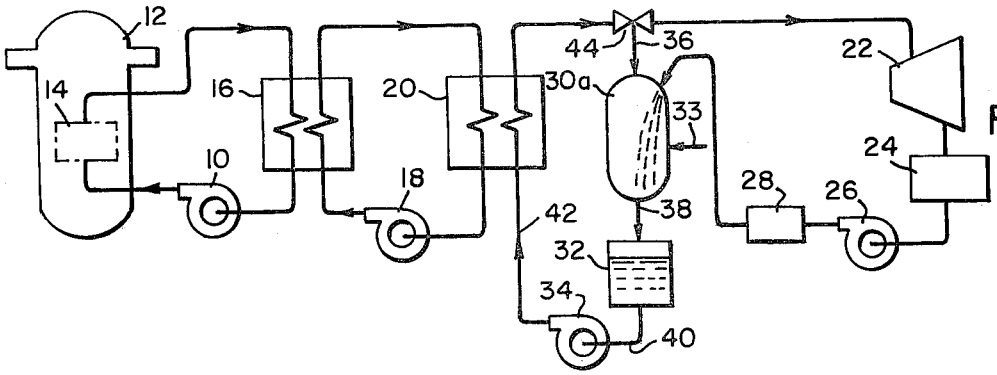

FIG. 3 shows another embodiment, differing primarily in operation of the preheater. The preheating component is here a spray condenser **30*a*, in which feed fluid from the feed fluid heater 28 is mixed with the fluid stream in conduit 36. This embodiment is an alternate method to minimize concerns associated with the approach temperature difference in the preheater as no heat transfer surface, such as tubes, are required. The capacity of pump 34** must now be increased to pass total flow of feed fluid. However, the size and complexity of the preheater can be reduced.

Figure 4:
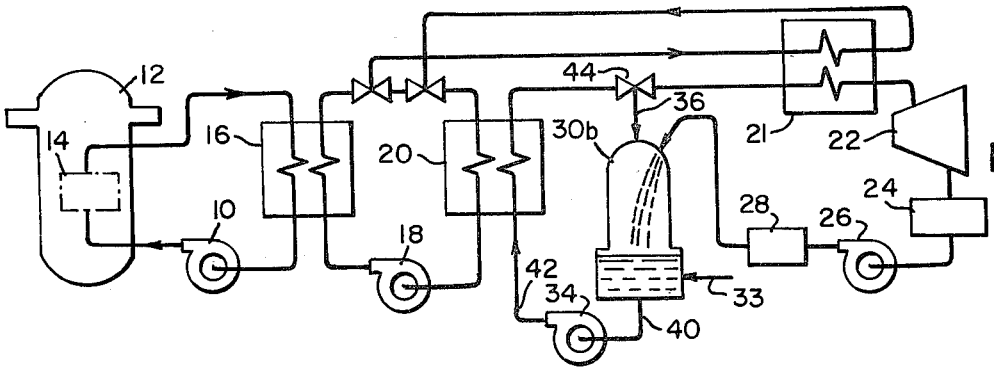

FIG. 4 shows yet another embodiment incorporating a spray condenser preheater **30*a* in a utilization circuit with a separate superheating unit 21. Also shown is the combining of the preheater and the inventory tank into one component 30*b*. Combining the inventory tank with the preheater 30, 30*a*** could of course be done in any of the embodiments discussed.

It is therefore seen that this invention provides a thermal power plant which minimizes the potential for detrimental thermal and chemical effects on the steam generator. It will be apparent that many modifications and variations are possible in light of the above teachings. It therefore is to be understood that within the scope of the appended claims, the invention may be practiced other than as specifically described.

We claim:

1. An improved thermal power plant comprising a primary fluid circuit between a nuclear reactor heat source and a heat exchanger, an intermediate fluid circuit between said heat exchanger and a steam generator, and a utilization circuit through which is circulated a fluid vaporizable in said steam generator, said steam generator comprising an evaporator section in which said vaporizable fluid vaporizes, said utilization circuit comprising a steam superheater in which said fluid is superheated, turbine, condenser, preheater between said condenser and said steam generator placing in heat transfer relation condensed fluid and a minor portion of fluid exiting said steam generator so as to preheat said condensed fluid, an inventory tank receiving said minor portion after passage of said portion through said preheater, means to combine fluid from said inventory tank with said previously condensed and preheated fluid, and means to discharge said combined fluid to said steam generator.

2. An improved thermal power plant comprising a primary fluid circuit between a nuclear reactor heat source and a heat exchanger, an intermediate fluid circuit between said heat exchanger and a steam generator, and a utilization circuit through which is circulated a fluid vaporizable in said steam generator, said steam generator comprising an evaporator section in which said vaporizable fluid vaporizes, said utilization circuit comprising a steam superheater in which said fluid is superheated, turbine, condenser, preheater between said condenser and said steam generator placing in heat transfer relation condensed fluid and a minor portion of fluid exiting said steam generator so as to preheat said condensed fluid, a desuperheater through which said minor portion is cooled by some of said previously condensed fluid prior to entry into said preheater, an inventory tank receiving said minor portion after passage of said portion through said preheater, means to combine fluid from said inventory tank with said previously condensed and preheated fluid, and means to discharge said combined fluid to said steam generator.

3. The power plant of claim 1 wherein said inventory tank is an integral part of said preheater.

4. The power plant of claim 1 wherein said minor portion comprises up to 15 percent of the volumetric flow of said fluid exiting said steam generator.

5. A method of power generation which comprises circulating a primary heat transporting fluid within a circuit including a nuclear reactor heat source, circulating an intermediate heat transfer fluid within another circuit, effecting heat transfer between said primary and intermediate heat transporting fluids, circulating a vaporizable fluid within a utilization circuit, vaporizing said fluid by heat transfer with said intermediate fluid, then separating said vaporizable fluid into a major and minor portion, expanding and condensing said major portion, then preheating by heat exchange means said condensed fluid with said minor portion, then collecting said minor portion in a vessel, then mixing fluid from said vessel and said previously condensed and preheated major portion, and then discharging the mixed fluid to effect said heat transfer between said intermediate and vaporizable fluids.

6. A method of power generation which comprises circulating a primary heat transporting fluid within a circuit including a nuclear reactor heat source, circulating an intermediate heat transfer fluid within another circuit, effecting heat transfer between said primary and intermediate heat transporting fluids, circulating a vaporizable fluid within a utilization circuit, vaporizing said fluid by heat transfer with said intermediate fluid, then separating said vaporizable fluid into a major and minor portion, expanding and condensing said major portion, cooling said minor portion by mixing with some of said previously condensed fluid, then preheating by heat exchange means the balance of said condensed fluid with said minor portion and said some condensed fluid, then collecting said minor portion and said some condensed fluid in a tank, then mixing fluid from said tank and said previously condensed and preheated major portion, and then discharging the mixed fluid to effect said heat transfer between said intermediate and vaporizable fluids.

7. An improved thermal power plant comprising a primary fluid circuit between a nuclear reactor heat source and a heat exchanger, an intermediate fluid circuit between said heat exchanger and a steam generator, and a utilization circuit through which is circulated a fluid vaporizable in said steam generator, said steam generator comprising an evaporator section in which said vaporizable fluid vaporizes and a steam superheater section in which said fluid is superheated, said utilization, circuit comprising a turbine, condenser, a spray condenser combining condensed fluid and a minor portion of said superheated fluid, an inventory tank receiving said combined fluid, and means to discharge said inventory tank to said steam generator.

8. A method of power generation which comprises circulating a primary heat transporting fluid within a circuit including a nuclear reactor heat source, circulating an intermediate heat transfer fluid within another circuit effecting heat transfer between said primary and secondary heat transporting fluids, circulating a vaporizable fluid within a utilization circuit, vaporizing and superheating said fluid by heat transfer with the secondary fluid, then separating said fluid into a major and minor portion, expanding and condensing said major portion, then mixing said condensed fluid and said minor portion in a spray condenser, then discharging the mixed fluid to a collection tank, and then discharging fluid from said tank to effect said heat transfer between said intermediate and vaporizable fluids.

9. An improved thermal power plant comprising a primary fluid circuit between a nuclear reactor heat source and a steam generator, and a utilization circuit through which is circulated a fluid vaporizable in said steam generator, said steam generator comprising an evaporator section in which said vaporizable fluid vaporizes and a steam superheater section in which said fluid is superheated, said utilization circuit comprising a turbine, condenser, preheater between said condenser and said steam generator placing in heat transfer relation at least some of said condensed fluid and a minor portion of said superheated fluid so as to preheat said at least some condensed fluid, an inventory tank receiving said minor portion after passage of said portion through said preheater, means to combine fluid from said inventory tank with preheated fluid, and means to discharge said combined fluid to said steam generator.

10. An improved thermal power plant comprising a primary fluid circuit between a nuclear reactor heat source and a steam generator, and a utilization circuit through which is circulated a fluid vaporizable in said steam generator, said steam generator comprising an evaporator section in which said vaporizable fluid vaporizes and a steam superheater section in which said fluid is superheated, said utilization circuit comprising a turbine, condenser, a spray condenser combining condensed fluid and a minor portion of said superheated fluid, an inventory tank receiving said combined fluid, and means to discharge said inventory tank to said steam generator.

11. The power plant of claim 9 further comprising a desuperheater through which said minor portion is cooled by at least some of said condensed fluid prior to entry into said preheater.

* * * * *